US007642734B2

(12) United States Patent
De Anna

(10) Patent No.: US 7,642,734 B2
(45) Date of Patent: Jan. 5, 2010

(54) METHOD AND SYSTEM FOR DIMMING LIGHT SOURCES

(75) Inventor: Paolo De Anna, Vallà Di Riese Pio X (IT)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 536 days.

(21) Appl. No.: 11/339,492

(22) Filed: Jan. 26, 2006

(65) Prior Publication Data

US 2006/0170370 A1 Aug. 3, 2006

(30) Foreign Application Priority Data

Feb. 2, 2005 (EP) ..... 05425043

(51) Int. Cl.
*G05F 37/02* (2006.01)

(52) U.S. Cl. ..... 315/308

(58) Field of Classification Search ..... 315/224, 315/219, 307, 225, 291, 313–314, 315, DIG. 4, 315/DIG. 2, 312, 308; 362/800; 345/82
See application file for complete search history.

(56) References Cited

U.S. PATENT DOCUMENTS 4,428,016 A * 1/1984 Brasfield ..... 361/18
5,144,117 A * 9/1992 Hasegawa et al. ..... 235/455
6,633,472 B2 * 10/2003 Lai ..... 361/93.1
6,897,623 B2 * 5/2005 Yoneda et al. ..... 315/291
7,015,825 B2 * 3/2006 Callahan ..... 340/815.45
2003/0117087 A1 6/2003 Barth et al. ..... 315/291
2003/0214242 A1 11/2003 Berg-johansen ..... 315/169.3
2004/0195983 A1 * 10/2004 Toyota et al. ..... 315/312

FOREIGN PATENT DOCUMENTS

DE 198 10 827 9/1999
DE 100 51 139 4/2002
JP 2003-152224 5/2003

* cited by examiner

*Primary Examiner*—Douglas W Owens
*Assistant Examiner*—Minh D A

(57) ABSTRACT

Dimming a light source such as a LED over a dimming range (0%-100%) involves adjusting at least one of the intensity (I) and the duty-cycle (DR) of a current flowing through the light source. The dimming range includes at least one portion (L%-H%; 0%-H%) where the light source is fed with a current whose intensity (I) is switched with a given duty cycle (DR) between a non-zero on value and zero, the non-zero on value being a fraction of the rated value (Irated), whereby joint CC and PWM dimming is achieved.

18 Claims, 3 Drawing Sheets

METHOD AND SYSTEM FOR DIMMING LIGHT SOURCES

FIELD OF THE INVENTION

Figure 1:
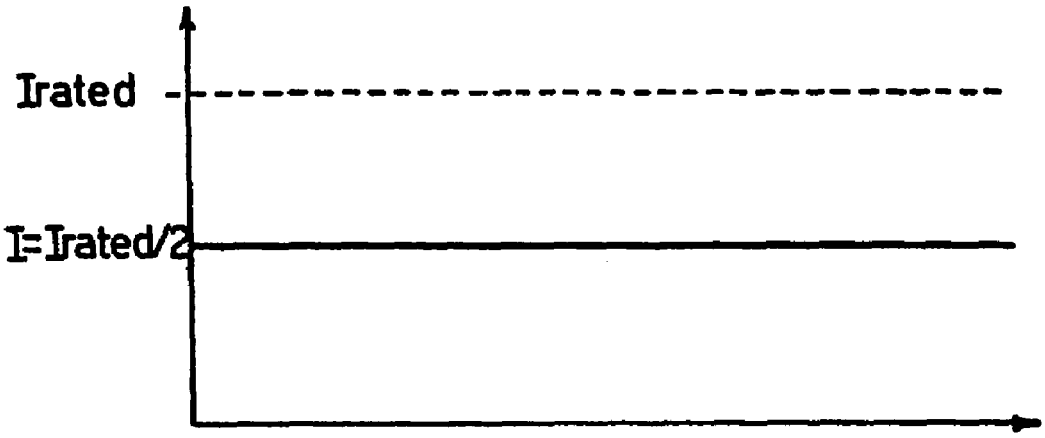

The present invention relates to techniques for dimming light sources such as e.g. light emitting diodes (LEDs).

The invention was devised by paying specific attention to the possible application in those arrangements wherein the brightness of a light emitting diode is caused to change as a function of a current flowing through the LED.

DESCRIPTION OF THE RELATED ART

Document DE-A-198 10 827 discloses a circuit providing current to a light emitting diode (LED) wherein a current source is connected to the LED to provide current. The circuit includes a logic gate to regulate the current supply to the LED depending on the LED temperature. The logic gate can reduce the current supply to the LED when a temperature threshold is exceeded and increase the current if the temperature falls below the threshold. The logic gate can provide a difference voltage from the flux voltage applied to the LED and a reference voltage with constant current through the LED. The difference voltage acts as a control signal for switching the LED current supply on or off. Such a kind of pulse width modulation (PWM) is reported to guarantee optimal current supply to the LED, independent of LED temperature, while also ensuring optimal brightness of the LED. In such prior arrangement, the purpose of modulation is to reduce the average current on the LED in order to control the maximum junction temperature. The arrangement in question also permits to modify the related duty-cycle by lowering the modulation frequency.

Document US-A-2003/0117087 discloses a control circuit for at least one LED for adjusting the current and/or the voltage of the LED by means of a controller; the current, the voltage and/or the luminescence of the LED are detectable and comparable with the desired value. Specifically, the maximum current regulated is switched on and off, once again suggesting that a PWM arrangement is used to adjust light intensity.

Additional prior art arrangements include the arrangement disclosed e.g. in DE-A-197 32 828 including PWM address circuits for a LED array including a two-transistor switch for setting the desired current for any number of diodes in parallel or for different brightness. Specifically, in the arrangement described in such a prior art document, the array has a number of light-emitting diodes (LEDs) connected in parallel between an inductor and earth. The inductor is supplied with current from a source via a PWM switch incorporating two transistors gated by logic circuitry. A bootstrap capacitor for the gate voltages connects the logic to the common connection of the switch and inductor. To enable a small inductor to be used, the PWM switch operates at a frequency preferably greater than 20 kHz. Such a circuit is reported to be particularly adapted for use e.g. for rear lights of motor vehicles, and to operate with particularly low losses, guaranteeing almost constant current through the LEDs.

Furthermore, JP-A-2003152224 describes a LED drive circuit for a liquid crystal display, including a detector for detecting the value of the current supplied to the drive circuit and comparing the detected value with a standard value. The comparison output is input to an output voltage control circuit of a LED drive voltage rise circuit having a voltage control oscillator (VCO) and pulse width modulation PWM function. The voltage control circuit controls the comparison output such that it corresponds with the reference voltage value. The arrangement in question is adapted for driving light emitting diodes in liquid crystal display units as used in mobile telephones, to provide constant current, high efficiency drive.

By way of summary, techniques for dimming light sources such as light emitting diodes (LEDs) can be referred to two basic approaches, namely constant current (CC) control and pulse-width modulation (PWM) control. Both approaches rely on the fact that the brightness of a light source such as a light emitting diode (LED) is a function of the (average) current flowing through the light source (e.g., the diode junction, in the case of a LED). Consequently, a dimming function (that is, changing the brightness of the light source) can be obtained by adjusting the intensity of the current flowing through the light source.

FIG. 1 is exemplary of a standard CC dimming technique. Specifically, in the arrangement schematically referred to in FIG. 1, a constant current I is caused to flow through the light source (throughout the rest of this description a LED will be referred to for the sake of simplicity). Instead of value corresponding to the maximum rated LED current (Irated), the current I is adjusted to a given intensity that is a fraction of the rated LED current (Irated) and the LED is consequently dimmed.

By way of example, FIG. 1 refers to an operating condition where the continuous current I flowing through the diode is I=Irated/2 (namely 50% of Irated). In this example the LED is dimmed at 50%.

A basic disadvantage of constant current (CC) dimming is wavelength drift: CC dimming a LED produces, in addition to the desired change in light intensity, an undesired wavelength drift that may essentially be perceived by the viewer as a change of colour of the light from the diode.

Figure 2:
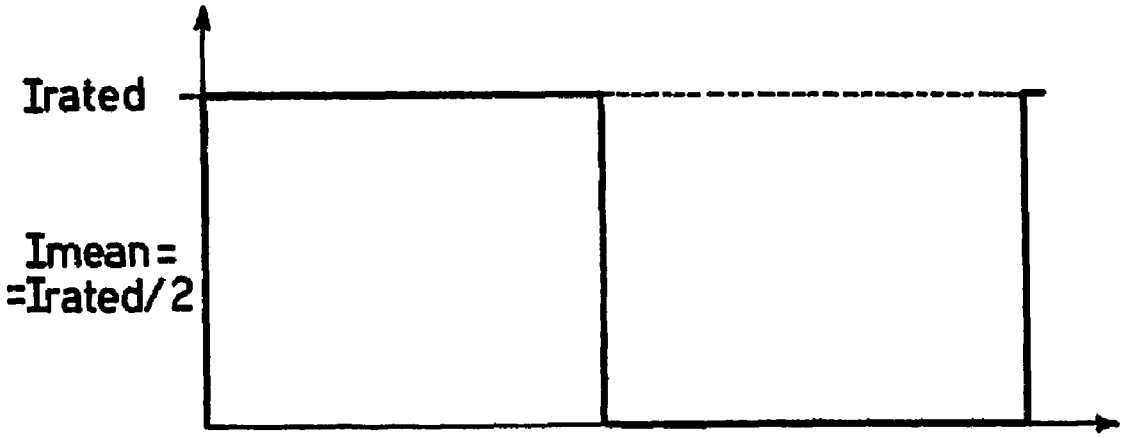

A way of dispensing with such wavelength drift is to resort to pulse width modulation (PWM) dimming as schematically shown in FIG. 2. In PWM dimming the current I through the diode is not kept constantly at the maximum rated value Irated but rather switched in the form of a square wave between the "on" value Irated and an "off" value (typically zero).

The PWM technique takes advantage of the persistence of images on the retina of the human eye as a low pass filter in order to obtain an average light flux which is proportional to the ratio of the interval where the current is at the "on" level Irated to the period of the PWM pulses. Such period is comprised of the sum of the interval where the current where the current is at the "on" level and the interval where the current intensity is zero. This ratio is currently referred to as the "duty-cycle" (or "duty ratio") of the current I.

In PWM dimming, when fed with current, the LED is always driven with a constant current (the "on" current) at the rated value Irated. In the exemplary case shown in FIG. 2, the duty-cycle of the PWM waveform is set at 50%. In fact the interval where the current is at the "on" level Irated is 50% (i.e. one half) the period of the PWM pulses, namely the sum of the interval where the current where the current is at the "on" level and the interval where the current intensity is zero. The LED is thus dimmed at 50% since the average current Imean through the diode is essentially the "on" current Irated times the duty-cycle (in this case Imean=Irated/2). For PWM frequencies above 100 Hz, the low pass filtering properties of the human eye lead to the LED light being perceived by a human observer as a constant and stable output light.

A basic limitation of the PWM technique lies in that, if the LED brightness is to be reduced to zero without discontinuities (in order to achieve a continuous and a smooth fading down to zero without any visible step change in the light output), the mean current value through the LED must be well controlled from the rated value Irated (usually between 300 and 1000 mA) down to a few hundreds microampere. This would in turn entail being able to produce a stable PWM duty-cycle of about 0.01%. At a pulse repetition frequency of 200 Hz this would correspond to about 500 nanoseconds of PWM "on" time.

Such a duty-cycle value is very difficult to achieve using standard low-cost PWM circuitry of the type expected to be associated with light sources such a LEDs. Moreover, the duty-cycle must be very stable at low brightness levels in order to avoid flickering. This is related to the fact that the human eye is quite sensitive at low brightness levels (log sensitivity). A low PWM "on" time is a serious problem also for the power stage feeding the LED, especially when the converter has to cover variable input and output voltage ranges.

Despite the significant efforts witnessed by the prior art documents considered in the foregoing, the need is still felt for an improved arrangement dispensing with the intrinsic drawbacks of the prior art arrangements considered in the foregoing.

The object of the invention is thus to provide an improved solution fulfilling such a need, thus providing a high performance dimming system for light sources such as high efficiency LEDs, while avoiding additional drawbacks such as e.g. colour shifting produced by variations in the drive current.

According to the present invention, that object is achieved by means of a method having the features set forth in the claims that follow. The invention also relates to a corresponding system. The claims are an integral part of the disclosure of the invention provided herein.

In brief, the arrangement described herein combines CC and PWM control techniques while dispensing with the limitations of either technique.

A preferred embodiment of this arrangement thus provides for dimming over a dimming range a light source (such as e.g. a LED) having a rated current value; dimming involves, over at least one portion of the dimming range, the (joint) operations:

- feeding the light source with a current whose intensity is switched with a given duty cycle (DR) between an on value and an off value, and
- adjusting at least one of said on and off values to a fraction of said rated value.

A particularly preferred embodiment of the invention thus provides for such dimming to involve, over said at least one portion of the dimming range, the (joint) operations of:

- feeding the light source with a current whose intensity is switched with a given duty cycle between a non-zero on value and a zero off value, and
- adjusting said non-zero on value to a fraction of said rated value.

BRIEF DESCRIPTION OF THE ANNEXED DRAWINGS

Figure 3:
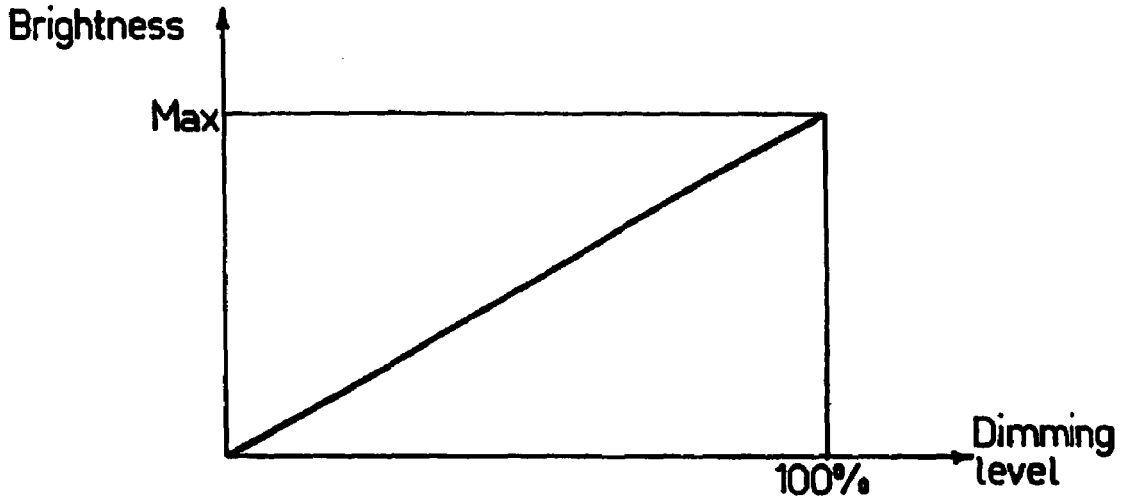
Figure 4:
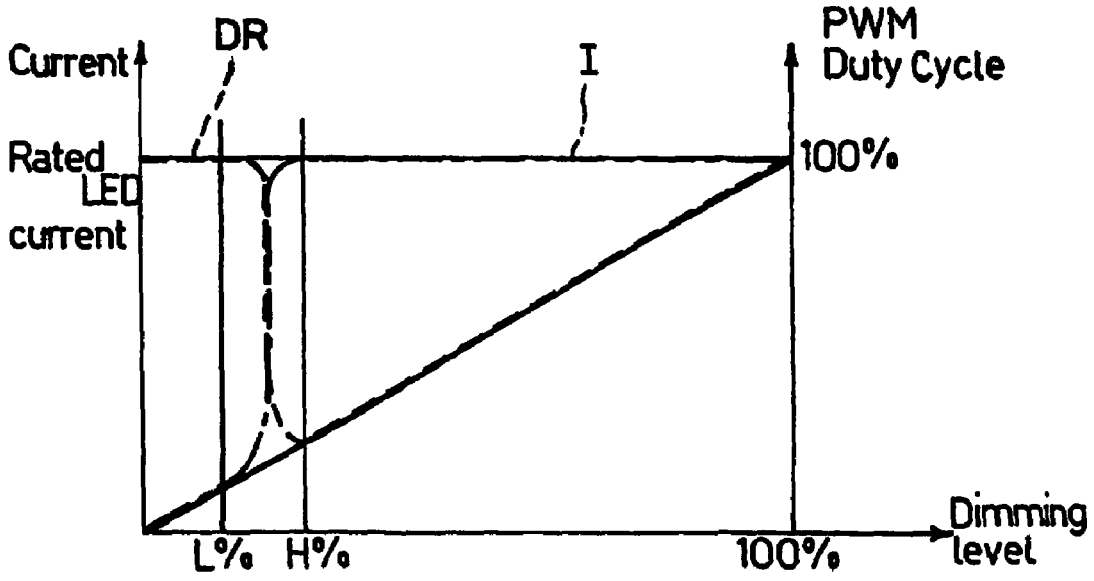
Figure 5:
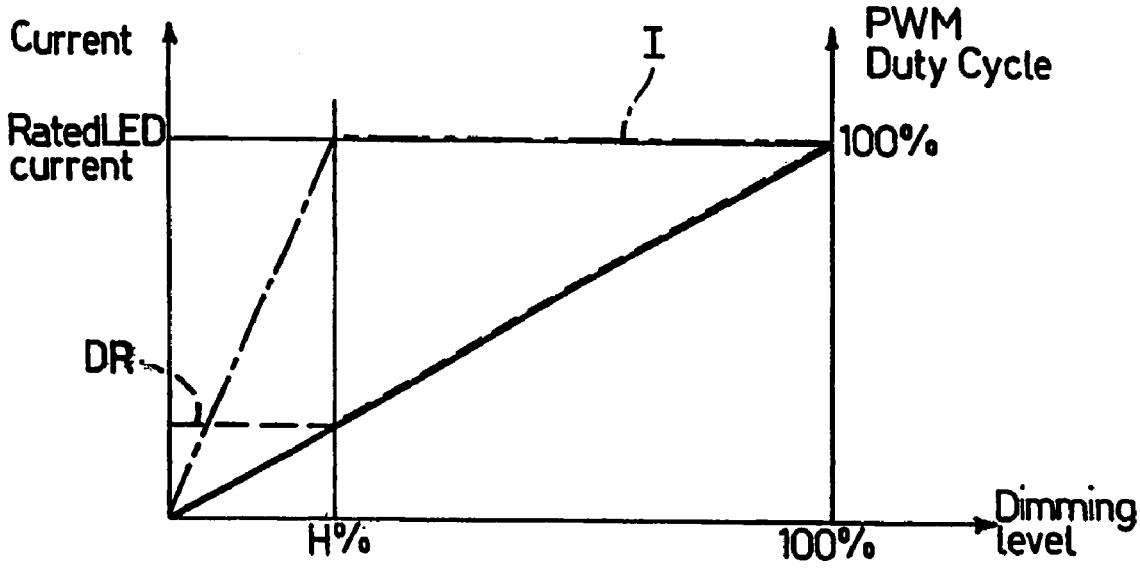
Figure 6:
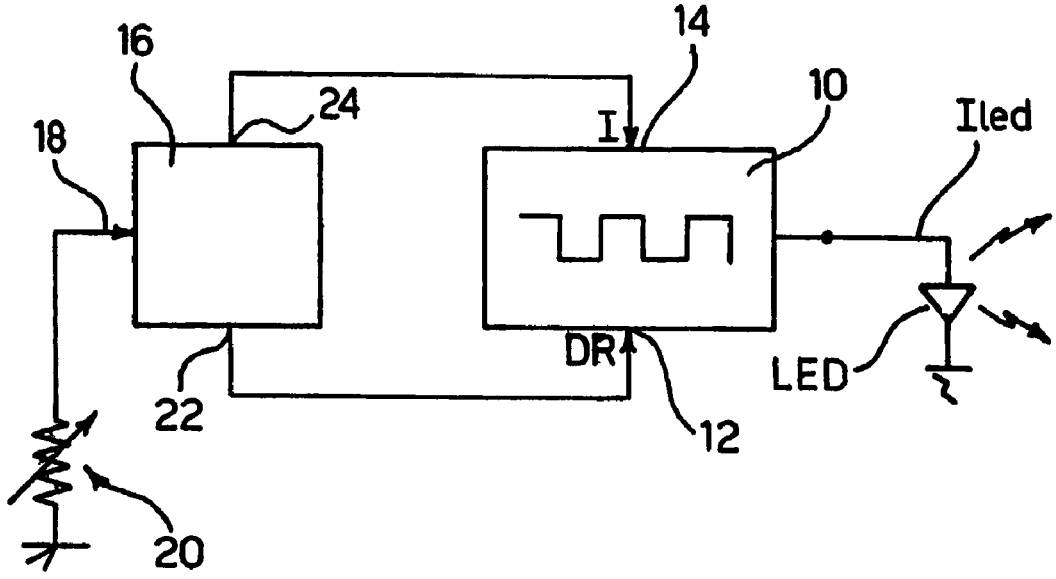

The invention will now be described, by way of example only, with reference to the enclosed figures of drawing, wherein:

FIGS. 1 and 2, exemplary of standard CC and PWM dimming, were already discussed in the foregoing, FIG. 3 is a chart showing a relationship of brightness to dimming level, FIGS. 4 and 5 are exemplary of two possible embodiments of the arrangement described herein, and FIG. 6 is a block diagram of a circuit adapted to implement the arrangement described herein.

DETAILED DESCRIPTION OF EXEMPLARY EMBODIMENTS OF THE INVENTION

By way of direct comparison to the CC and PWM arrangements described with reference to FIGS. 1 and 2, the arrangement described herein mixes those two techniques while avoiding the drawbacks exhibited by either technique when taken alone.

The arrangement described herein aims at achieving operation according to the diagram shown in FIG. 3 where the abscissa scale represents the dimming level of a light source such as a LED and the ordinate scale represents the light source brightness. Essentially, the diagram of FIG. 3 corresponds to an exemplary linear relationship between the dimming level (0-100%) and the LED brightness (0-Max). It will be appreciated that—according to the standard practice in the industry—the scale for the "dimming level" is indexed in terms of resulting light intensity, whereby 0% and 100% dimming levels correspond to the LED emitting no light and maximum light intensity, respectively.

As indicated, the linear relationship (i.e. function) shown in FIG. 3 is purely exemplary. In fact, other kinds of relationships between the dimming level (0-100%) and the LED brightness (0-Max) may be resorted to, an exponential relationship being a case in point. At least for certain applications, an exponential relationship may represent a preferred choice. In any case, a linear relationship, as shown, and an exponential relationship are examples for a wide class of adjustment relationships or functions adapted to be implemented using the arrangement described herein.

As discussed previously in the presentation of the related art, the behaviour shown in FIG. 3 (or essentially any other kind of relationships between the dimming level and the LED brightness) can be obtained—per se—by using either a CC technique (FIG. 1) or a PWM technique (FIG. 2).

If a CC technique is used, the level of continuous current injected into the diode is representative for the dimming level (with the maximum brightness when the current through the diode is 100% of Irated and 0 dimming level when no current flows through the diode I=0).

If a PWM technique is used, a maximum level of brightness i.e. 100% dimming is obtained for a 100% duty-cycle (current always "on"), while a 0% dimming level (no light emitted from the diode) is obtained when the PWM duty-cycle is notionally set to zero.

Conversely, in the arrangement described herein, the dimming range (0 to 100%) is arranged to include at least one portion where both PWM dimming (i.e. feeding the light source with a current whose intensity is switched with a given duty cycle between a non-zero "on" value and an "off" value), and CC dimming (i.e. adjusting the non-zero "on" value to a fraction of said rated value Irated) are used jointly.

Specifically, the diagram of FIG. 4 is representative of an exemplary embodiment wherein the dimming range (0 to 100%) is partitioned in three portions, namely:

0 to L%;

L% to H%; and

H%-100%.

Exemplary, non limiting values for L% and H% are 2% and 10%, respectively.

In a lowest portion of the dimming range (namely, 0% to L%), an unswitched constant current is generated by the LED driver, whereby the LED brightness can be adjusted at the desired value by adjusting the intensity of the unswitched constant current (CC method only).

An intermediate portion of the dimming range (namely, L% to H%) provides for the current level being adjusted at increased values up to the rated LED current (Irated) and PWM is applied in order to obtain the desired mean current value, whereby both the CC and the PWM techniques are used in a mixed manner.

It will be appreciated that, in the portion L% to H% of the dimming range shown in FIG. 4, the light source (LED) is fed with a current whose intensity I is switched with a given duty cycle between a non-zero "on" value and a zero "off" value, while the non-zero on value is adjusted to a fraction of the rated value Irated.

Finally, in a highest portion of the dimming range (namely, H% to 100%), only PWM dimming is applied and, when "on", the LED is driven with his rated current. The LED brightness can thus be adjusted by correspondingly adjusting the PWM duty cycle (PWM method only).

In the diagram of FIG. 4 the PWM duty-cycle DR is shown in dashed line starting at 100% in the interval between 0 and L% and then caused to smoothly change (in the interval L%-H%) to a value approximately corresponding to the desired dimming level to increase then gradually (depending on the desired dimming function e.g. in a linear manner) towards the value 100%.

In the same diagram, the chain line represents the "on" current in the LED which is gradually linearly varied in the interval between 0% and L% and then caused to rapidly increase to the rated current value Irated in the interval L% to H%. The continuous line of FIG. 4 represents the mean current flowing to the LED expressed in percentage of the value Irated.

Consequently, in the specific arrangement shown, in the portion L% to H%, CC dimming and PWM dimming are used both jointly (i.e. together) and dynamically, in that the ratio of the "on" current intensity to the maximum rated value Irated, and the duty cycle DR are varied to produce a desired dimming/brightness behaviour.

This is exemplary of the general possibility, admitted by the arrangement described herein, of varying over at least one portion of the dimming range:

the duty cycle DR, and at least one of the "on" and "off" values of the switched current fed to the light source (in the case shown, the "on" value is varied, since the "off" value is fixedly set to zero).

More to the point, in the portion L% to H% of the diagram of FIG. 4, the dimming process involves gradually bringing to the rated value Irated the non-zero "on" value of the PWM switched current, and jointly decreasing the duty-cycle DR of the PWM switched current by gradually increasing the resulting average current through said light source LED.

The diagram of FIG. 4 is thus exemplary of an embodiment wherein, in addition to the portion 0%-H% (where CC and PWM dimming are resorted to jointly), the dimming range 0%-100% includes:

a portion 0%-L%, where the light source is fed with a continuous, unswitched current whose intensity I is a fraction of the rated value Irated and the intensity that continuous, unswitched current (i.e. the value of the fraction in question) is varied in order to achieve the desired dimming level, and a further portion H%-100%, where the light source is fed with a current whose intensity I is switched with a given duty cycle DR between the rated value Irated and zero and the duty cycle DR is varied in order to achieve the desired dimming level.

It will be appreciated that all the threshold indicated (L%, H%) can be varied at will, while the PWM adjustment curve and the "on" period current adjustment curve for different values of dimming level can have shapes different from those shown.

The diagram of FIG. 5 is representative of an alternative, presently preferred embodiment of the arrangement described herein. In such presently preferred embodiment, the dimming range (0 to 100%) is partitioned in just two portions (instead of three portions as is the case of the diagram of FIG. 4), namely:

0 to H%; and

H%-100%.

In the arrangement of FIG. 5, over the interval 0-H%, the current is gradually increased towards the rated LED current (Irated) and the duty-cycle DR is kept at a fixed level e.g. lower than 100%. This is again exemplary of the joint use of CC and PWM dimming. In fact, in the portion 0% to H% of the dimming range shown in FIG. 5, the light source (LED) is fed with a current whose intensity I is switched between a non-zero "on" value and zero with a given duty cycle DR, and the non-zero on value is adjusted to a fraction of the rated value Irated.

It will be further appreciated that in this—purely exemplary—case the duty cycle DR is adjusted to a fixed value over the whole range 0%-H%, while the non-zero on value is adjusted variably, according e.g. to a ramp like function to a fraction of the rated value Irated.

In the arrangement of FIG. 5, over the interval H%-100%, the current is kept at the rated LED current level (Irated) and the duty-cycle is gradually linearly increased towards 100% (PWM dimming only).

The diagram of FIG. 5 is thus exemplary of an embodiment wherein, in addition to the portion 0%-H% (where CC and PWM dimming are resorted to jointly), the dimming range 0%-100% includes a further portion H%-100%, where the light source is fed with a current whose intensity I is switched with a given duty cycle DR between the rated value Irated and zero and the duty cycle DR is varied in order to achieve the desired dimming level.

By way of direct comparison, the arrangement of FIG. 5 can be somehow considered as derived from the arrangement of FIG. 4 by dispensing with the rightmost portion of the arrangement of FIG. 4 were CC dimming only is used, thus putting L% to zero.

Additionally, in the range 0% to H% of the arrangement of FIG. 5, CC dimming and PWM dimming are used jointly (i.e. together) but the duty cycle DR is kept constant, whereby no "dynamic" PWM dimming is used and the changes in dimming level and light source brightness are produced by varying the level of the "on" current, i.e. by using what can be termed a sort of dynamic CC dimming.

It will thus be appreciated that there are notionally an infinite number of combinations that can be chosen from the shapes of the curves related to the duty-cycle and the current intensity in order to obtain a desired level of mean current Imean through the diode. A best combination can be chosen in order to overcome limitations and constraints of the related power/control circuitry.

FIG. 6 is a schematic block diagram of a circuit arrangement adapted to implement a LED dimming arrangement as described previously. In FIG. 6, reference 10 designates a current generator (of any known type) adapted to feed a light source such as a light emitting diode (LED) with a current Iled. Specifically, the current Iled can be generated with a duty-cycle notionally variable from 0 (no current) to 100% (continuous current) based on a control signal applied to a first control terminal 12. The intensity of the "on" current value is similarly adjustable by means of a further control signal applied to a second control terminal 14.

Reference 16 designates a processing circuit that can be easily implemented using a low-cost micro controller. The circuit 16 receives at an input 18 a signal (possibly of an analogue type, adapted to be converted to a digital value by an input analogue-to-digital converter associated with the input of the circuit 16) corresponding to a dimming level set by control unit such as e.g. a potentiometer or a "slider" 20. It will be appreciated that the control unit 20 may not in fact be a part of the circuit 16 but rather represent a separate component that is associated (i.e. connected) to the circuit 16 only when the complete arrangement is assembled.

The circuit 16 can be easily configured (for instance in the form of a so-called look-up table or LUT) in order to:

receive at the input 18 an input signal identifying a desired dimming level for the LED being controlled, and output at the output terminals 22 and 24 two signals corresponding to i) the duty-cycle value and ii) the current intensity value to be brought to the inputs 12 and 14 of the current generator 10.

The structure and connection of the control unit 20 to the circuit 16 may be configured (in a known manner) in order to establish a given desired relationship (i.e. dimming function, slected form linear, exponential, and so on as desired) between the light source current intensity and the desired dimming level.

Entries in a look-up table can be easily arranged (in a manner known per se, making it unnecessary to provide a more detailed description herein) in order to implement any desired diagram such as e.g. the diagrams of FIGS. 4 and 5.

For instance, in connection with the diagram of FIG. 4, whenever the dimming level set acting on the control unit 20 is in the interval between 0% and L%, the output on the terminal 22 (duty-cycle) is kept at 100% while the output value on the output 24 (current intensity) is set as a function (e.g. proportionally) to the desired dimming level, thus achieving CC-only dimming operation.

When the dimming level set by acting on the control unit 20 is in the range between H% and 100%, the current value fed from the output 24 to the input 14 of the current generator 10 is set at the maximum rated value while the duty-cycle value fed from the output 22 to the input 12 is caused to vary as a function (not necessarily as a linear function as exemplified in the diagram of FIG. 4) of the dimming level set by acting on the control unit 20, thus achieving PWM-only dimming operation.

When the dimming level set on the control unit 20 falls in the range between L% and H% the output values fed from the outputs 22 and 24 to the inputs 12 and 14, respectively, of the current generator 10 are read from the LUT contained in the processing unit 16 and correspond to the diagram shown in FIG. 4 thus achieving joint "CC plus PWM" dimming operation. Those of skill in the art will promptly appreciate that suitably programming e.g. a LUT may permit to easily implement any shapes of duty-cycles and "on" current values as desired.

Essentially a basic task performed by the control circuit or unit 16 in association with the control unit 20 is selectively defining a dimming level of the light source (LED) over a dimming range, while the current generator 10 is configured for generating the current for feeding the light source (LED) in such a way that, over at least a portion of dimming range of a light source (e.g. a LED), both PWM dimming (i.e. feeding the light source with a current whose intensity is switched between a non-zero "on" value and zero with a given duty cycle), and CC dimming (i.e. adjusting the non-zero "on" value to a fraction of the rated value Irated) are used jointly. The sub-ranges L% to H% of FIG. 4 and 0% to H% of FIG. 5 are exemplary of such a portion.

The processing circuit 16 is typically configured for generating control signals 22, 24 for controlling operation of the current generator 10 over a plurality of portions of the dimming range as a function of an input dimming signal 18 produced by the control unit 20.

The exemplary arrangements of FIGS. 4 and 5 are thus representative of embodiments where operation of the current generator 10 is controlled to produce respectively:

CC dimming only (0%-L%); mixed CC and PWM dimming (L%-H%), and PWM dimming only (H%-100%) over three subsequent adjacent portions of the desired dimming range 0% to 100%, and mixed CC and PWM dimming (0%-H%), and PWM dimming only (H%-100%) over two adjacent portions of the desired dimming range 0% to 100%.

The arrangement described herein takes therefore advantages of both CC and PWM dimming methods. The wavelength of e.g. a LED adjusted thereby can be kept constant over a wide dimming interval (e.g. H% to 100%), while at the same time smooth and stable fading to 0% can be achieved using a CC method in a lower range. "Handover" between the two dimming techniques can be managed smoothly in order to avoid discontinuity or steep changes in the dimming curve and action.

Of course, without prejudice to the underlying principles of the invention, the details of construction and the embodiments may vary widely with respect to what is described and illustrated herein purely for the purpose of providing an example, without thereby departing from the scope of the present invention as defined in the claims that follow. For instance, all the examples made throughout this description refer to PWM dimming being performed jointly with CC dimming by feeding a light source with a current whose intensity is switched with a given duty cycle between a non-zero on value and a zero off value. Those of skill in the art will however appreciate that, although in a less preferred manner, such PWM switching may involve an "off" value that is non zero, and thus take place e.g. between an "on" value corresponding to the rated value Irated and a non-zero "off" value that can be adjusted to a fraction of the rated value (Irated) in atypical CC dimming arrangement.

The invention claimed is:

1. A method for powering a light source at selectable brightness levels over a dimming range, the method comprising the steps of:

partitioning the dimming range (0%-100%) into a plurality of portions; and feeding a current to the light source in dependence upon both: (a) a selected brightness level; and (b) the portion of the dimming range corresponding to the selected brightness level, wherein, for a selected brightness level that is within at least one of the plurality of portions of the dimming range:

(i) the current fed to the light source is a discontinuous, switched current that is switched at a duty cycle between an on value and an off value; and (ii) the on value is a fraction of a rated current for the light source, and is adjusted in dependence upon the selected brightness level.

2. The method of claim 1, wherein the off value is substantially equal to zero.

3. The method of claim 1, wherein the light source includes at least one light emitting diode.

4. The method of claim 1, wherein:

the step of partitioning includes partitioning the dimming range (0%-100%) into a first portion (0%-L %), a second portion (L %-H %), and a third portion (H %-100%); and the step of feeding includes:

(i) for a selected brightness level that is within the first portion (0%-L %) of the dimming range, feeding to the light source a continuous, unswitched current having an intensity that is a fraction of a rated current for the light source, wherein the fraction of the rated current is adjusted in dependence upon the selected brightness level;

(ii) for a selected brightness level that is within the second portion (L %-H %) of the dimming range, feeding to the light source a discontinuous, switched current that is switched at a duty cycle between an on value and an off value, wherein: (a) the duty cycle is adjusted in dependence upon the selected brightness level; and (b) the on value is a fraction of the rated current, and is adjusted in dependence upon the selected brightness level; and (iii) for a selected brightness level that is within the third portion (H %-100%) of the dimming range, feeding to the light source a discontinuous, switched current that is switched at a duty cycle between the rated current and the off value, wherein the duty cycle is adjusted in dependence upon the selected brightness level.

5. The method of claim 4, wherein the off value is substantially equal to zero.

6. The method of claim 4, wherein the light source includes at least one light emitting diode.

7. The method of claim 1, wherein:

the step of partitioning includes partitioning the dimming range into a first portion (0%-H %) and a second portion (H %-100%); and the step of feeding includes:

(i) for a selected brightness level that is within the first portion (0%-H %) of the dimming range, feeding to the light source a discontinuous, switched current that is switched at a fixed duty cycle between an on value and an off value, wherein: (a) the fixed duty cycle is independent of the selected brightness level; and (b) the on value is a fraction of a rated current for the light source, and is adjusted in dependence upon the selected brightness level; and (ii) for a selected brightness level that is within the second portion (H %-100%) of the dimming range, feeding to the light source a discontinuous, switched current that is switched at a duty cycle between the rated current and the off value, wherein the duty cycle is adjusted in dependence upon the selected brightness level.

8. The method of claim 7, wherein the off value is substantially equal to zero.

9. The method of claim 7, wherein the light source includes at least one light emitting diode.

10. A circuit for powering a light source at selectable brightness levels over a dimming range that is partitioned into a plurality of portions, the circuit comprising:

a processing circuit for defining a selected brightness level for the light source; and a current generator coupled between the processing circuit and the light source, wherein the current generator is operable to feed a current to the light source in dependence upon both: (a) the selected brightness level; and (b) the portion of the dimming range corresponding to the selected brightness level, wherein, for a selected brightness level that is within at least one of the plurality of portions of the dimming range:

(i) the current fed to the light source is a discontinuous, switched current that is switched at a duty cycle between an on value and an off value; and (ii) the on value is a fraction of a rated current for the light source, and is adjusted in dependence upon the selected brightness level.

11. The circuit of claim 10, wherein the off value is substantially equal to zero.

12. The circuit of claim 10, wherein the light source comprises at least one light emitting diode.

13. The circuit of claim 10, wherein:

the dimming range (0%-100%) is partitioned into a first portion (0%- L %), a second portion (L % - H %), and a third portion (H %-100%); and the current generator is further operable:

(i) for a selected brightness level that is within the first portion (0%-L %) of the dimming range, to feed to the light source a continuous, unswitched current having an intensity that is a fraction of a rated current for the light source, wherein the fraction of the rated current is adjusted in dependence upon the selected brightness level;

(ii) for a selected brightness level that is within the second portion (L %-H %) of the dimming range, to feed to the light source a discontinuous, switched current that is switched at a duty cycle between an on value and an off value, wherein:

(a) the duty cycle is adjusted in dependence upon the selected brightness level; and (b) the on value is a fraction of the rated current, and is adjusted in dependence upon the selected brightness level; and (iii) for a selected brightness level that is within the third portion (H %-100%) of the dimming range, to feed to the light source a discontinuous, switched current that is switched at a duty cycle between the rated current and the off value, wherein the duty cycle is adjusted in dependence upon the selected brightness level.

14. The method of claim 13, wherein the off value is substantially equal to zero.

15. The method of claim 13, wherein the light source includes at least one light emitting diode.

16. The circuit of claim 10, wherein:

the dimming range is partitioned into a first portion (0%-H %) and a second portion (H %-100%); and the current generator is further operable:

(i) for a selected brightness level that is within the first portion (0%-H %) of the dimming range, to feed to the light source a discontinuous, switched current that is switched at a fixed duty cycle between an on value and an off value, wherein:

(a) the fixed duty cycle is independent of the selected brightness level; and (b) the on value is a fraction of a rated current for the light source, and is adjusted in dependence upon the selected brightness level; and (ii) for a selected brightness level that is within the second portion (H %-100%) of the dimming range, to feed to the light source a discontinuous, switched current that is switched at a duty cycle between the rated current and the off value, wherein the duty cycle is adjusted in dependence upon the selected brightness level.

17. The method of claim 16, wherein the off value is substantially equal to zero.

18. The method of claim 16, wherein the light source includes at least one light emitting diode.

* * * * *